US009214047B2

(12) United States Patent
Giovanetto et al.

(10) Patent No.: US 9,214,047 B2
(45) Date of Patent: Dec. 15, 2015

(54) EQUIPMENT FOR THE STORING OF VALUES IN SACK AND RESPECTIVE METHOD FOR THE ACCOUNT AND TRANSPORT OF THE STORED VALUES

(75) Inventors: Mauro Giovanetto, Bollengo (IT); Davide Vesco, Bollengo (IT); Alberto Faga, Bollengo (IT)

(73) Assignee: CTS Cashpro S.L.R., Bollengo (IT)

( * ) Notice: Subject to any disclaimer, the term of this patent is extended or adjusted under 35 U.S.C. 154(b) by 1075 days.

(21) Appl. No.: 13/254,544

(22) PCT Filed: Mar. 1, 2010

(86) PCT No.: PCT/EP2010/052574

§ 371 (c)(1),
(2), (4) Date: Nov. 4, 2011

(87) PCT Pub. No.: WO2010/100120

PCT Pub. Date: Sep. 10, 2010

(65) Prior Publication Data

US 2012/0042610 A1 Feb. 23, 2012

(30) Foreign Application Priority Data

Mar. 2, 2009 (IT) ..... TO2009A0153

(51) Int. Cl.
*B65B 57/00* (2006.01)
*B65B 43/26* (2006.01)
*G07D 11/00* (2006.01)

(52) U.S. Cl.
CPC ..... *G07D 11/0006* (2013.01); *G07D 11/0093* (2013.01)

(58) Field of Classification Search
CPC ..... E05G 1/00; G07D 11/00; G07D 2211/00; B65B 57/02; B65B 43/26; G06F 17/60; G07F 7/04; G07F 19/00
USPC ..... 53/469; 221/1, 197; 700/231
See application file for complete search history.

(56) References Cited

U.S. PATENT DOCUMENTS

2004/0003980 A1* 1/2004 Hallowell et al. ..... 194/206
2004/0139693 A1* 7/2004 Lamers ..... 53/67

(Continued)

FOREIGN PATENT DOCUMENTS

EP 1 369 826 A1 12/2003
EP 1 413 703 A2 4/2004

(Continued)

*Primary Examiner* — Andrew M Tecco
*Assistant Examiner* — Praachi M Pathak
(74) *Attorney, Agent, or Firm* — Sughrue Mion, PLLC

(57) ABSTRACT

An equipment (21) for the storing of values (23) as banknotes, checks and other documents in sack, comprising one or two filling and sealing units (26*a*, 26*b*) for a value sack or value sacks (24*a*, 24*b*) to be closed irreversibly, and which is coupled to an interface unit (31) of a deposit and withdrawal machine (22). A transfer safe (27) lodges the filling and sealing unit or units and the value sacks and an introduction unit (42) is connected with the interface unit (31) for transferring the values. The introduction unit (42) includes a stacking device (43) for the values (23) to be stored in sack, a bundling device (44) for bundling the formed stacks and a moving and transferring mechanism (46) for shifting the stacks between the stacking device, the bundling device and the filling and sealing unit or units. A method for making easier and accelerating the operations of account and transport of the stored values is also described.

3 Claims, 8 Drawing Sheets

(56) References Cited

U.S. PATENT DOCUMENTS

| | | | | |
|---|---|---|---|---|
| 2005/0077347 | A1* | 4/2005 | Uematsu et al. | 235/379 |
| 2005/0086140 | A1* | 4/2005 | Ireland et al. | 705/35 |
| 2007/0210149 | A1* | 9/2007 | Osterberg et al. | 235/379 |
| 2008/0082207 | A1* | 4/2008 | Sjostrom | 700/231 |
| 2008/0135608 | A1* | 6/2008 | Ireland et al. | 232/1 D |
| 2009/0118860 | A9* | 5/2009 | Sjostrom | 700/231 |

FOREIGN PATENT DOCUMENTS

| | | | | |
|---|---|---|---|---|
| EP | 1 739 632 | A2 | 1/2007 | |
| EP | 1739632 | A2 * | 1/2007 | G07D 11/00 |
| GB | 2 352 006 | A | 1/2001 | |
| WO | 2008/151773 | A1 | 12/2008 | |

* cited by examiner

EQUIPMENT FOR THE STORING OF VALUES IN SACK AND RESPECTIVE METHOD FOR THE ACCOUNT AND TRANSPORT OF THE STORED VALUES

CROSS REFERENCE TO RELATED APPLICATIONS

This application is a National Stage of International Application No. PCT/EP2010/052574 filed Mar. 1, 2010, claiming priority based on Italian Patent Application No. TO2009A000153 filed Mar. 2, 2009, the contents of all of which are incorporated herein by reference in their entirety.

FIELD OF THE INVENTION

The invention relates to an equipment for the storing of values in sack values and a method for the account and transport of the stored values.

More specifically, the invention relates to an equipment for the storing of values as banknotes, checks and other documents in sack, co-operating with a machine for the automatic processing of values and a respective method for the account and transport of the stored values, according to the introductory portions of the main claims.

Containers or disposable sacks are known in the technique be used in automatic equipments for collecting values and sealing the containers or sacks. The values can be constituted by banknotes, checks or other documents.

BACKGROUND OF THE INVENTION

Equipments for the collection of values and the sealing of value sacks are employed in commercial centres, supermarkets, banks or similar, as adjunctive components of deposit and withdrawal machines for the automatic processing of banknotes. In the use, the value sack is mounted internally to the machine, typically in a safe, with the mouth maintained open for receiving the banknotes. Upon the filling of the sack, the equipment provides to the sealing, by welding or gluing the edges of the mouth. Thereafter, the sack can be removed and transported in other place, generally a Cash in Transit (CIT) for the control and the accounting of the transported values.

In the known equipments for the collection of values and sealing of the value sacks, the banknotes are withdrawn from the deposit and withdrawal machine and transferred into the sack, independently of the respective denomination. Then, the personnel of the CIT Centre provide to validate, re-count the banknotes and form orderly stacks either manually or with expensive and cumbersome specialized machines.

The known equipments for the storage of values in sack require, besides the presence of the CIT personnel, the presence of cash personnel for opening the safe of the deposit and withdrawal machine. The effective transfer of the values to the deposit's account of the owner of the transported values is effected only after the physical reception of the value sacks at the CIT Centre and validation and counting operations of the, normally undifferentiated, values. It causes clearly delays in the accounting of the transported values and additional expenses.

SUMMARY OF THE INVENTION

An object of the present invention is to obviate to the above mentioned drawbacks, by accomplishing an equipment for the storing of values in sack, having a relatively simple and economic structure and allowing a reliable control of the accounting data of the values to be transferred and a minimum use of personnel, with safety against fraudulent actions.

Another object of the invention is to provide a method using an equipment for the storing of values in sack, directed to make easier and accelerated the operations of account and transport of values in sack.

The equipment according to the invention has a filling and sealing unit for a value sack to be closed irreversibly and is coupled to a deposit and withdrawal machine having a deposit safe with a series of value boxes and an interface unit for the deposit and delivery of values. The equipment comprises a transfer safe for lodging the filling and sealing unit and a value sack or more value sacks and in which an introduction unit is connected with the interface unit for transferring the values to be stored in sack. The introduction unit includes a stacking device for forming respective stacks with the values to be stored in sack; a bundling device for bundling the stacks of the stacking device; and a moving and transferring mechanism for shifting the formed stacks between the stacking device and the bundling device, and the bundled stacks between the bundling device and the filling and sealing unit.

The method of the invention is directed to make easier and accelerate the account of values in sack and provides the use of an equipment for the storing of values in sack comprising one or more filling and sealing units for a value sack or more value sacks to be closed irreversibly, and a transfer safe for lodging the filling and sealing unit o unities. The management of the deposit and withdrawal machine is of the deposit's organization owner of the values to be transferred while the responsibility of the values in the transfer safe is of another organization, as the CIT organization responsible of transport, control and accounting of the values. The method comprises, in detail, the followings steps:

a) providing a bundling device connected with the deposit and withdrawal machine for entering the values to be transferred as bundled stacks;

b) verifying the entering of the stacks into the transfer safe and directed to the filling and sealing unit o unities;

c) transmitting to the transport, control and accounting organization (CIT Centre) data associated to the values of the transferred stacks and data of identification of the sack or the sacks, functional to the transferring of the property of the values from the organization owner of the values to be transferred to the CIT organization;

d) actuating the filling and sealing unit or units for the irreversible sealing of the value sack or sacks, preliminarily to the opening of the transfer safe;

e) equipping the cash in transit with keys for opening the transfer safe and functional to the removal of the value sack or sacks closed irreversibly and the loading of an empty value sack or empty value sacks, with following closing of the transfer safe; and f) supplying information regarding the removal of the sealed value sacks and the insertion of the empty value sack or sacks.

Another object of the invention is to provide an equipment for the storing of values in sack which allowing to automatically obtain a firm, sure and irreversible sealing, such that a following opening to the sealing would determine a tamper evidence.

A further object of the invention is to provide an equipment for storing values in sack which allows to make easier the replacing of full value sacks with new ones.

Suitably, the equipment of the invention comprises an input unit for receiving sequentially values and a filling and sealing unit for a value sack, actuatable for irreversibly closing the value sack. The equipment provides a transfer safe for the filling and sealing unit and one or more disposable value sacks, each one provided of a machine-readable code and which defines a mouth with two edges and sack hooking sections adjacent to the edges. An edge is provided of a sticking strip for an irreversible sealing of the sack, while a protective film, provided for the sticking strip, has a bending and a film hooking section. For the value sack or for each sack, the filling and sealing unit comprises two edge support elements for supporting the sack hooking sections and a film control element. In particular, the edge support elements are provided for reciprocal movement between a condition of opening in which the edges are spaced away and the mouth open for receiving the values and a condition of closing for the pressure of the edge with the sticking strip against the other edge. The film control element operates jointly with the movement of the edge support elements for tearing the film from the sticking strip, ensuring the sealing in the condition of closing of the edge support elements; the transfer safe can be closed and the equipment rendered operative after reading of the code and correct insertion of the sack, while the opening causes the irreversible closing of the value sack or the value sacks.

BRIEF DESCRIPTION OF THE FIGURES

The characteristics of the invention will become clear from the following description given purely by way of non-limiting example, with reference to the appended drawings in which.

DETAILED DESCRIPTION OF THE PREFERRED EMBODIMENTS

Figure 1:
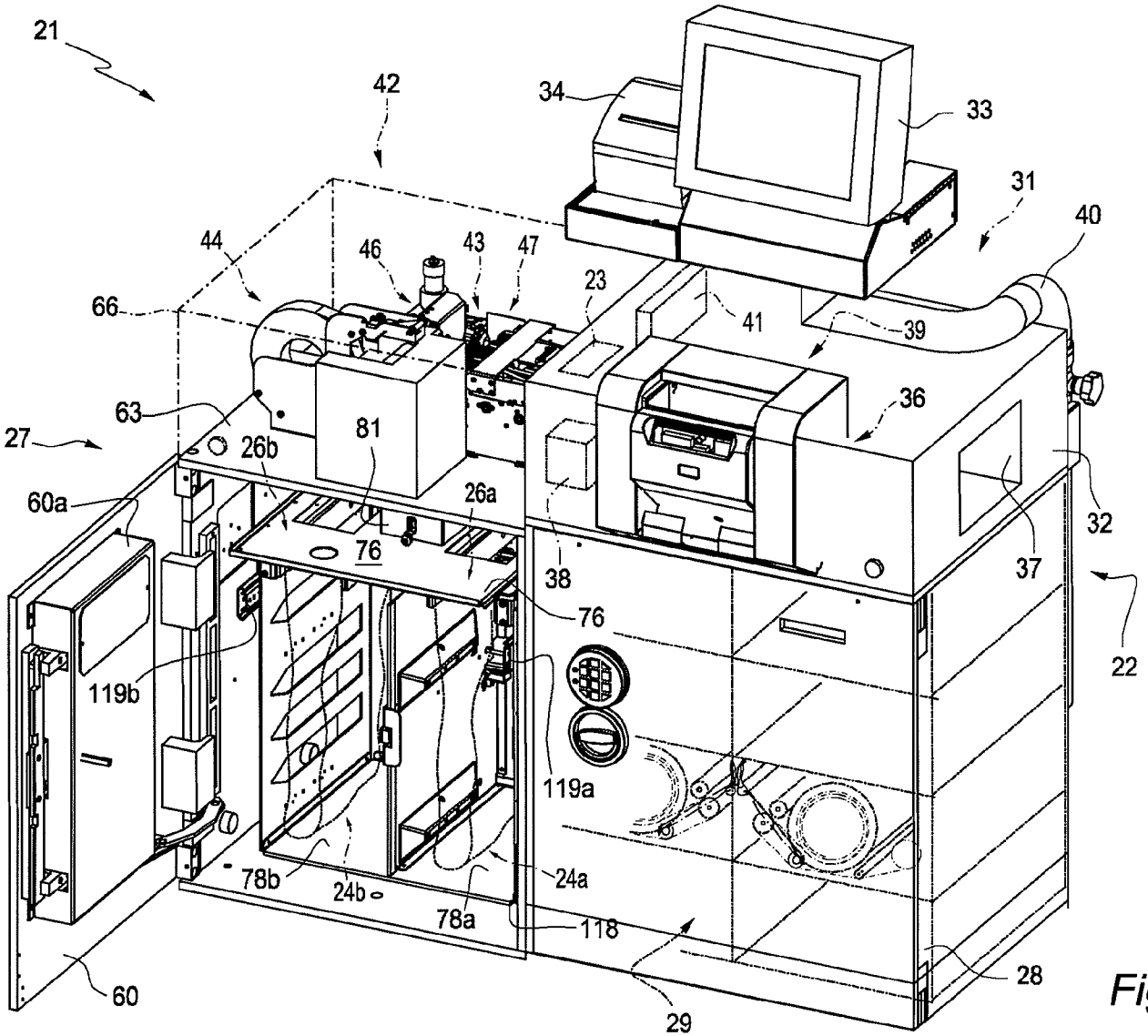
FIG. 1 represents a perspective view of an equipment for the storing of values in sack, according to the invention, coupled with a deposit and withdrawal machine for the automatic processing of values.
Figure 2:
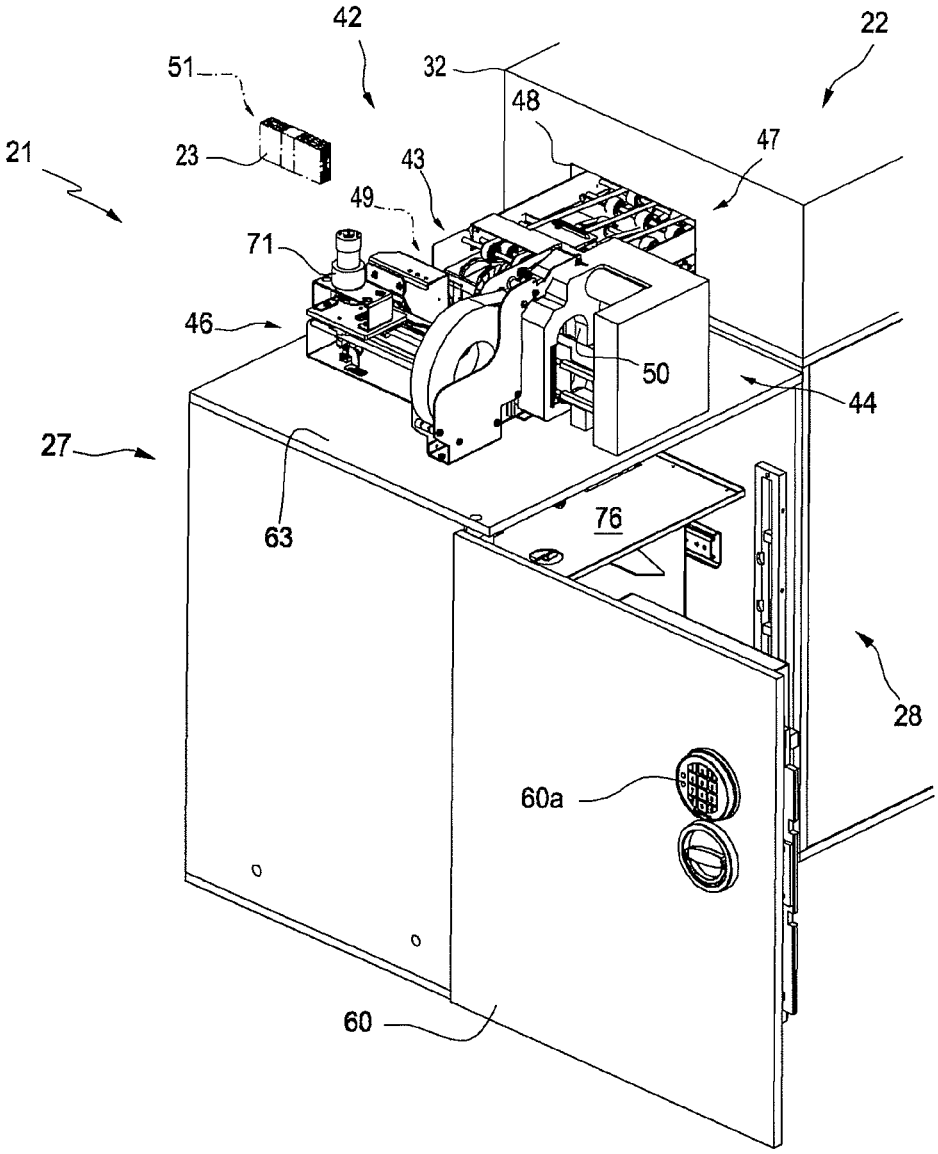
FIG. 2 is a partial view of the equipment of FIG. 1.

With reference to FIG. 1, an equipment for the storing of values in sack, has been represented with 21. The equipment 21 is coupled to a deposit and withdrawal machine 22 for the automatic processing of values, while the values, represented with 23 are, for instance, banknotes, checks or other accounting documents.

Figure 9:
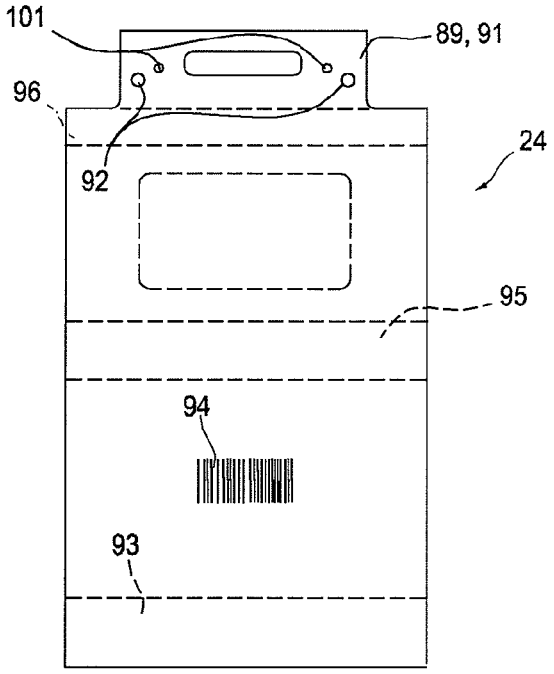
FIG. 9 shows a schematic view of a value sack used in the equipment according to the invention.
Figure 10:
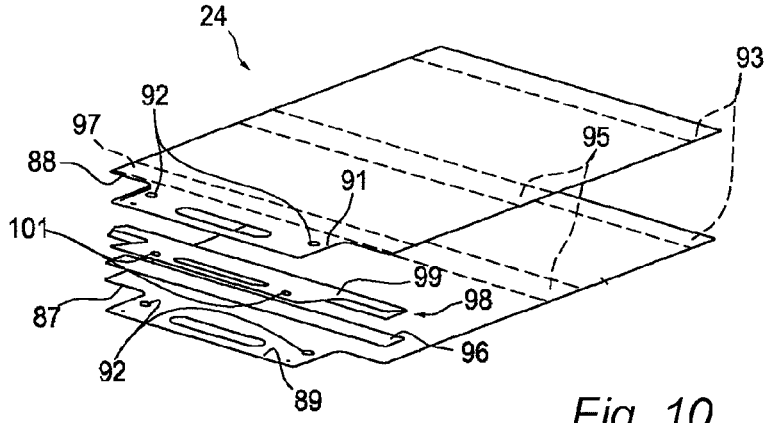
FIG. 10 is a schematic view exploded of some components of the value sack of FIG. 9.

The equipment 21 employs a value sack 24 (FIGS. 9 and 10) or more value sacks to be closed irreversibly for tamper evidence and comprises a filling and sealing unit 26*a* (FIG. 1) for a value sack 24*a*, or more filling and sealing units for more value sacks, and a transfer safe 27, of lodging for the filling unit or units and the value sack or sacks. The deposit and withdrawal machine 22 includes a deposit safe 28 with a series of value boxes 29, an interface unit 31 protected by an cover 32 with lock, a display 33 and a printer 34.

Figure 3:
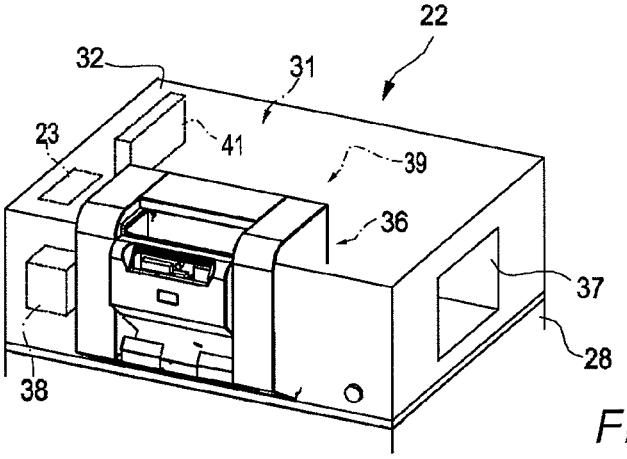
FIG. 3 is, a view of some components of the deposit and withdrawal machine of FIG. 1.

The deposit and withdrawal machine 22 and the respective value boxes 29 are of the type described in the Italian Patent N. 1.285.312 assigned to CTS Cashpro S.p.A. The interface unit 31 (FIG. 3) comprises a transaction port 36 for the entering and the rendering of values to be deposited, an output port 37 for the values to be withdrawn and a validation unit 38 for the values to be deposited. A transport mechanism 39 moves the values between the transaction port 36 and the boxes 29 through the validation unit 38 and between the boxes 29 and the transaction port 37. Suitably, an arm 40 supports the display 33 and the printer 34, countlever with respect to the upper surface of the cover 32, with possibility of rotation around a vertical axis for easy access, for service, to the devices protected by the cover 32. An electronic units 41 or more electronic units control the various components of the machine 22 and the equipment 21 and the transfer of data with the host management system for the transactions.

According to the invention, the equipment 21 (FIGS. 1÷8) comprises an introduction unit 42 connected to the interface unit 31 of the machine 22 for transferring the values 23 to be stored in sack. In detail, the introduction unit 42 includes a stacking device 43, a bundling device 44 and a moving and transferring mechanism 46.

The stacking device 43 is connected, through an input transferring mechanism 47 to an output 48 of the interface unit 31 of the machine 22 for entering the values 23 to be transferred for forming a stack 49 with a quantity of introduced values 23 determined by program or manually. The bundling device 44, of known type, comprises a hollow operative section 50 and is provided for arranging a wrapper around each stack 49, so as to obtain a respective bundled stack 51. The moving and transferring mechanism 46 is designated for shifting the stacks 49 between the device 43 and the bundling device 44 and the stacks 51 between the device 44 and the filling and sealing unit 26*a*.

The stacking device 43 is of the type with a pair of stacking wheels 52 and has a seat for receiving the values of the stack 49 in formation with arrangement of the values in vertical and support on a longer edge. In detail, the stack bears on a trap door 53, against a movable shoulder 54 and a fixed wall 56. Compacting elements 57 provide to level the edges of the values of the stack 49. Specifically, these compacting elements comprise a vertically actuatable shovel 58 and a respective actuating mechanism 59 including pulley and toothed belt elements and a, not shown, motor.

The moving and transferring mechanism 46 defines the position of the formed stack 49 in the device 44 for the bundling. Further, the mechanism 46 shifts the bundled stack 51 from the bundling device 44 to a transfer passage for the filling and sealing unit 26*a*.

Specifically, the transfer safe 27 has a door 60 with an electronically controlled lock 60*a* and comprises an opening 61 defined at an upper surface 62 of the safe 27 and arranged below the transfer passage. The stacking device 43 and the bundling device 44 are mounted on a plate 63 arranged above the surface 62, while the transfer passage is defined by a window 64 of the plate 63 encircling the trap door 53 and faced to the opening 61. A cover 66 with lock, fixed to the surface 62 protects the devices 43 and 44 and the mechanism 46.

The moving mechanism 46 includes a carriage 67, of support for the movable shoulder 54, which is shiftable by a motor 68 through pulley and toothed belt elements, and a nipping group mounted on the carriage. This group includes a pressing element 69, an actuator constituted by a motor 71 and cam elements for the pressing element. The element 69 is actuatable between a position of disengagement, in which it allows the stacking of the values 23, and a position of nipping in which it presses the stack 49 against the shoulder 54.

After the complete forming of the stack 49, the actuating mechanism 59 pulls down the shovel 58 for the vertical levelling of the edges. In sequence and on control of the motor 71, the pressing element 69 compresses the stack against the shoulder 54. Then, the motor 68 is actuated with movement of the carriage so as to shift the stack 49 along the wall 56 up to make a few more than the half thereof to project into a hollow operative section 50 of the bundling device 44. After the bundling, the carriage 67 shifts the bundled stack 51 away from the hollow section 50, up to the centre of the trap door 53, while the motor 71 moves the pressing element 69 away from the same stack 51.

An opening/closing element is actuatable between a condition of closing and a condition of opening of the transfer passage 64, while a buffer seat for the filling and sealing unit 26*a* is provided for receiving the bundled stack 51 in the condition of opening of the opening/closing elements. A safety mechanism 73 is operative on the buffer seat and is actuatable to prevent any access to the filling and sealing unit in condition of missed or incomplete closing of the transfer passage.

The equipment 21 also comprises a counter of the entered value upstream from the stacking device 43 and a transit sensor, of known type and not shown, arranged inside the safe 27 and adjacent to the opening 61 for detecting the passage of the stacks 51 transferred to the transfer safe 27.

In detail, the opening/closing elements include the trap door 53, of basculating type, and a servomotor 74 actuatable for moving the trap door 53 between a horizontal position, of moving for the stack 49, 51 and interception of the window 64, and a vertical position enabling the access to the window 64 and the opening 61. The filling and sealing unit 26*a* defines a separating plate 76, below the surface 62 of the safe 27, and which defines a window 77*a* arranged above a vane 78*a* of housing of the value sack 24*a* and vertically offset with respect to the opening 61.

The buffer seat is constituted by a shutter box 81, bottom and top free, interposed between the upper surface 62 of the safe 27 and the separating plate 76 and shiftable between a receipt position and a transfer position: in the receipt position, the box 81 is vertically lined up with the opening 61 for receiving the bundled stack 51 with support on the separating plate 76 while, in the transfer position, the box 81 is vertically lined up with the window 77*a* for transferring, by falling, the stack 51 to the value sack 24*a*. The safety mechanism 73 includes a motor 82 and pulley and toothed belt elements 83 between the motor 76 and the shutter box 81 for shifting the box between the receipt position and the transfer position.

Suitably, the separating plate 76 presents, in an area of interest of the shutter box, ribs or projections 84 having directrix in the sense of movement of the box. In turn, the shutter box 81 has walls 85*a* and 85*b* perpendicular to the direction of movement. The lower edges of the walls 85*a* and 85*b* include notches 86 complementary to the ribs or projections 84 of the separating plate 76 for allowing a free shifting along the plate 76 of not bundled values up to the window 77*a*.

According to another characteristic of the invention, the equipment 21 includes more filling and sealing units, lodged in the transfer safe 27, for respective value sacks to be irreversibly closed. A switching mechanism is programmable for selectively shifting the bundled stacks toward the one or the other of the filling and sealing units.

Figure 7:
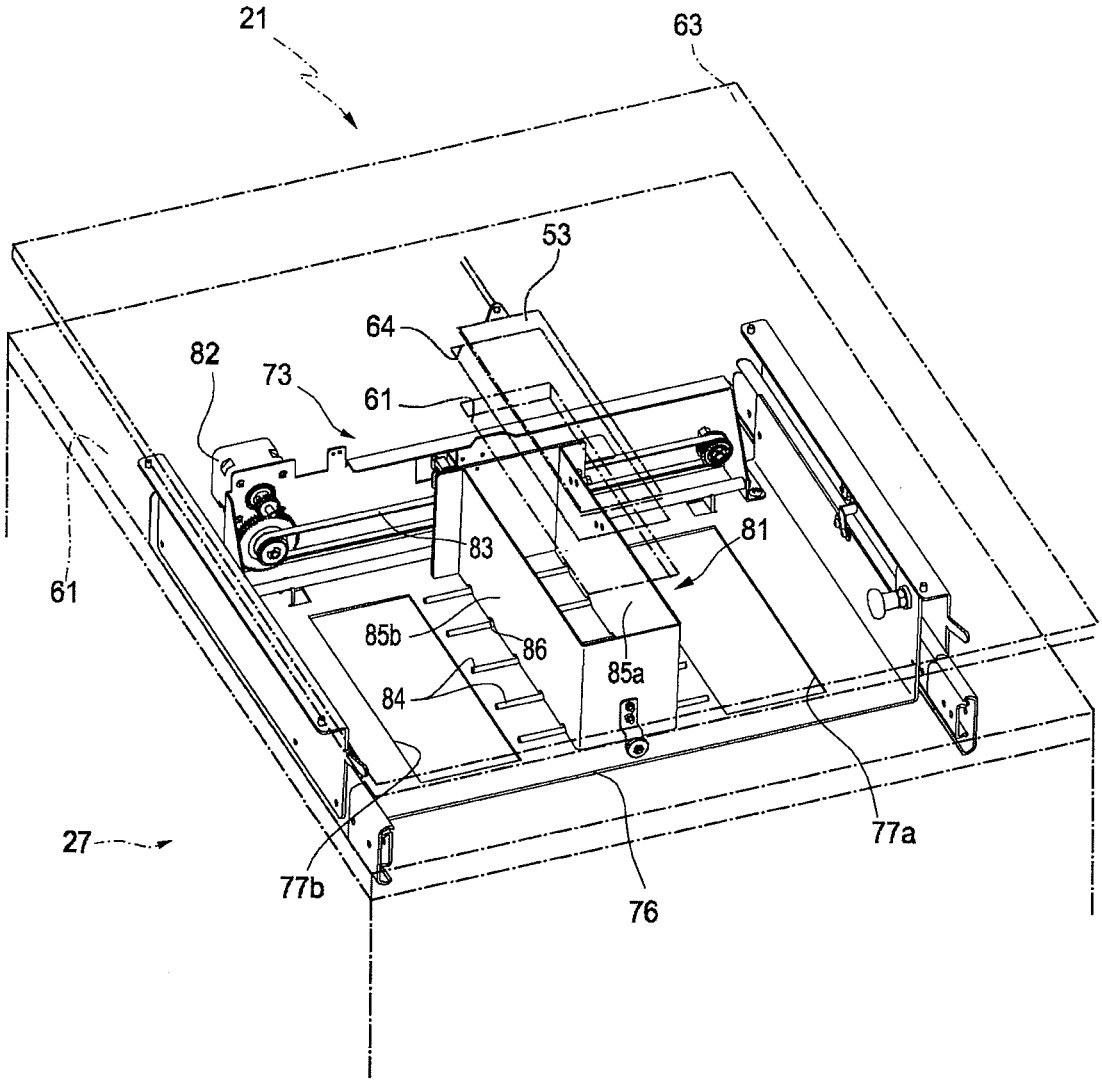
FIG. 7 represents a perspective view of some components of the equipment of FIG. 1.

In the embodiment of FIG. 1, the equipment 21 comprises a second filling and sealing units 26*b* for a second value sack 24*b*. The separating plate 76 has a second window 77*b* above a vane 78*b* for the value sack 26*b*, which is vertically offset with respect to the window 77*a* (See FIG. 7) by the other side of the opening 61. The switching mechanism comprises the shutter boxes 81 and the safety mechanism 73 and in which the motor 82 and the elements 83 move the shutter box 81 between the receipt position and one of two positions of transfer. In the first transfer position, the shutter box is lined up with the window 77*a* for the transfer of the stack 51 to the value sack 24*a* while, in the second position, the box 81 is lined up with the window 77*b* for the transfer of the stack to the sack 24*b*.

The value sack 24 (FIGS. 9 and 10), of disposable type, is constituted by a film of plastic material and defines a mouth with two edges 87 and 88 and sack hooking sections 89 and 91. The hooking sections 89 are shaped as handles, which project from the edges 87 and 88, and present hooking holes 92 spaced away from the edges 87 and 88. The sack 24 is substantially transparent except for an opaque section 93 adjacent to the lower edge and which carries an identification machine readable code, for example a bar code 94. In alternative, the sack 24 can be opaque but provided of a transparent control area 95. According to a further variant, the sack, of transparent material, is covered by a layer transparent to ultraviolet or other invisible rays, but opaque in the field of the visible spectrum, to prevent the view of the therein contained values.

The edge 87 of the value sack 24 is provided of a sticking strip 96 and tamper evidence, of known type. The strip 96 is couplable with a section 97 adjacent to the edge 88 for an irreversible sealing of the sack 24. Moreover, a protective film 98 is adherent to the sticking strip 96 for maintaining active in the time the sticking strip up to the moment of the closing. The film also prevents that a stack in transit can stick to the strip, or the possibility that some dust can negatively influence the sealing. In detail, the protective film 98 includes a strip overlapped to the sticking strip 96, a lower bending and a film hooking section 99, also shaped as handle, which is in registration with the hooking sections 89. The hooking section 99 of the protective film 98 is provided with hooking holes 101 also spaced away from the edges 87 and 88*a* little more than the hooking holes 92. Further, the sack 24 has airholes for the output of the air during the closing of the edges.

Figure 4:
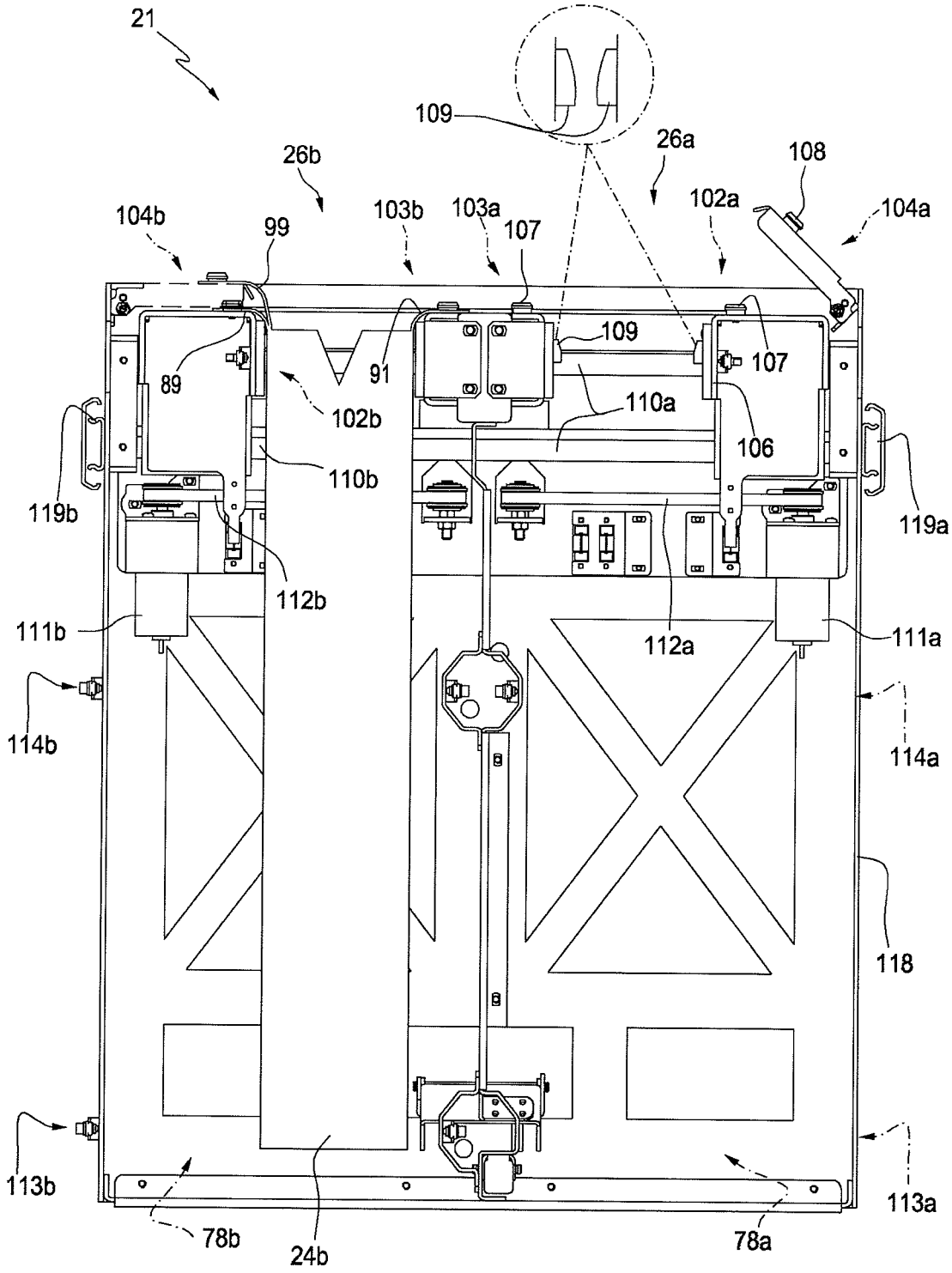
FIG. 4 shows a front view of some components of the equipment represented in FIG. 1.
Figure 5:
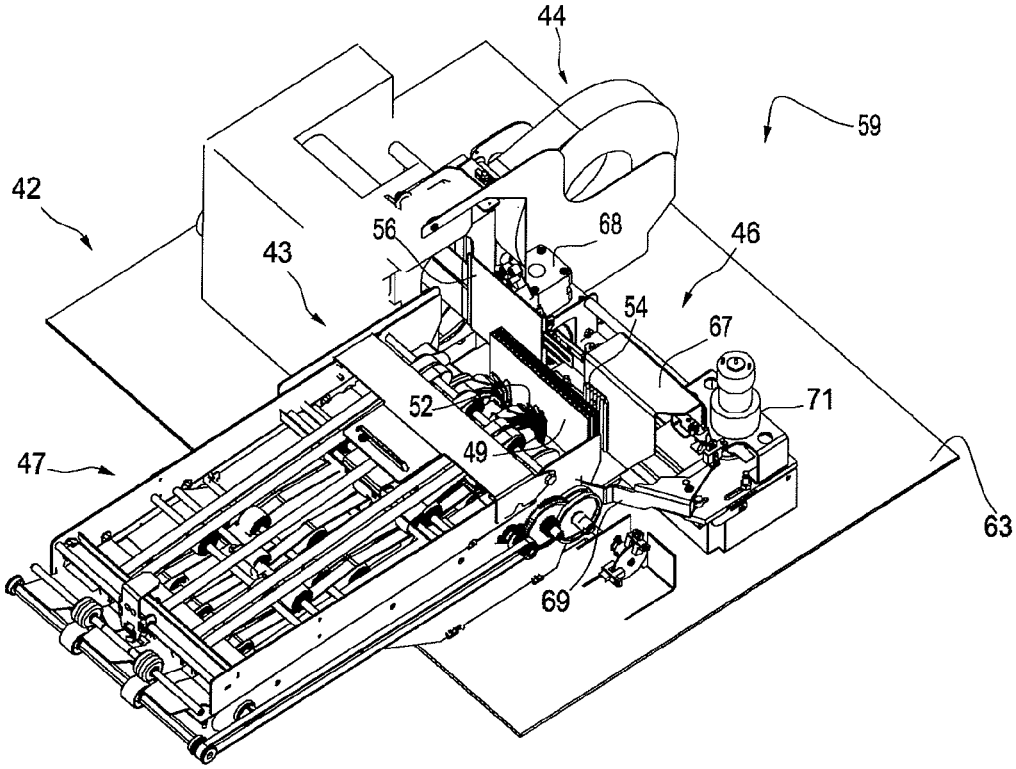
FIG. 5 is a view of some components of FIG. 2.
Figure 5A:
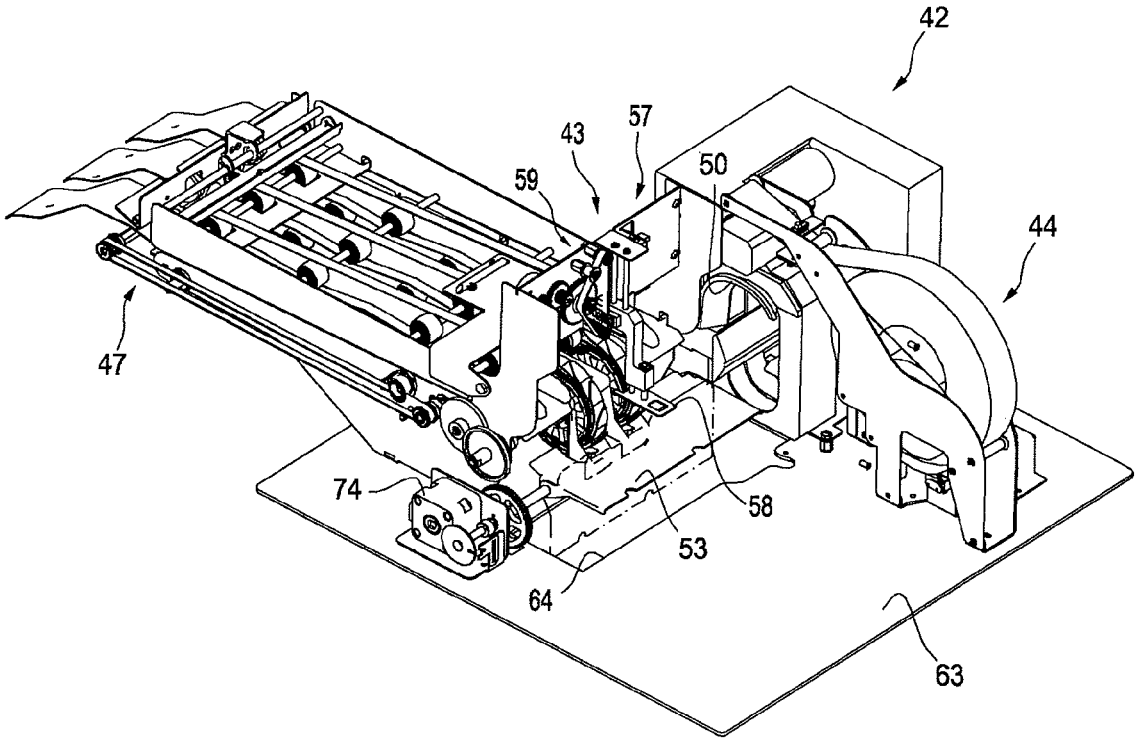
FIG. 5*a* is another view of some components of FIG. 2.
Figure 6A:
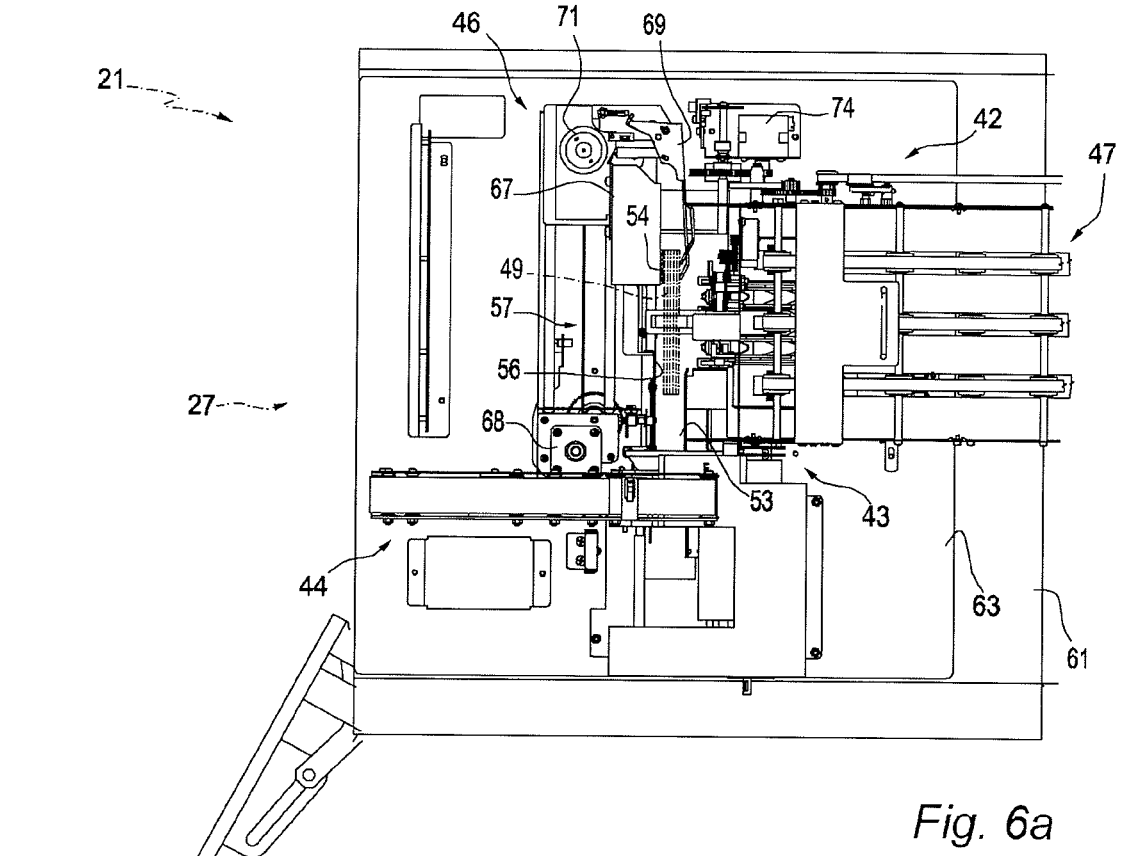
FIG. 6*a* is a plan view of some components of FIG. 2.
Figure 6:
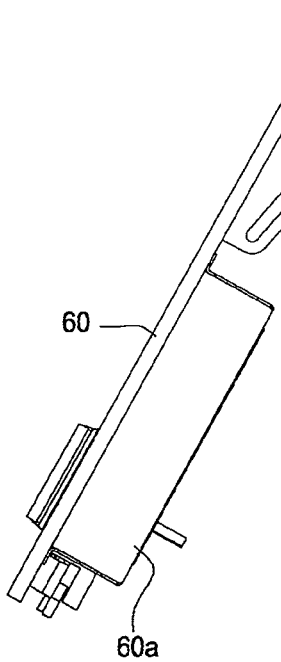
FIG. 6 shows, in enlarged scale, some components of FIG. 5.
Figure 6:
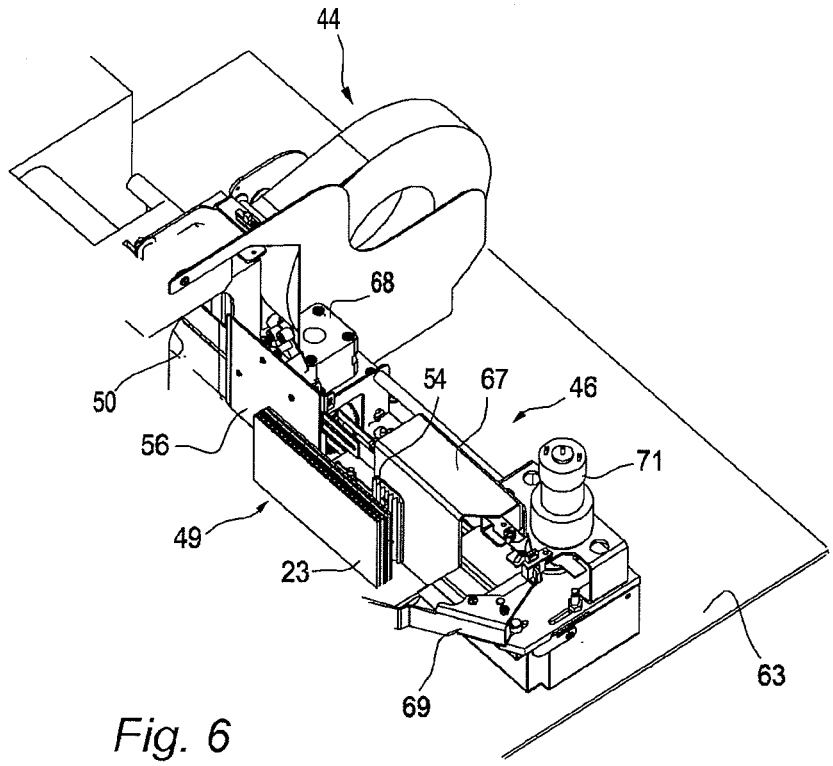

The filling and sealing unit 26*a*; 26*b* (FIGS. 4, 8, and 10) comprise, for the respective value sack 24*a*; 24*b*, two edge support elements 102*a*, 103*a*; 102*b*, 103*b* for supporting the sack hooking sections 89 and 91 and a film control element 104*a*; 104*b* and in which the edge support elements are provided for reciprocal movement between a condition of opening and a condition of closing. In the condition of opening, the edges 87 and 88 are maintained spaced away and the mouth is open for receiving the stacks 51. In the condition of closing, the edges 87 and 88 are pressed the one against the other.

In detail, the edge support elements have a front section 106 and an upper section with hooking pins 107 for the hooking holes 92 of the value sacks 24*a* and 24*b*. The film control elements 104*a* and 104*b* have hooking pins 108 for the hooking holes 101 of the protective films 98 and are operative jointly to the movement in closing of the support elements 102*a*, 103*a*; 102*b*, 103*b* to tear the films 98 by the sticking strips 96. On the mounting of a void sack, the handle shaped portion of the protective film 99 overcomes the handle shaped portion 89 for enabling the hooking holes 101 to be hanged to the hooking pins 108 of the film control element 104*a*, 104*b*.

In the condition of closing, the front sections 106 of the edge support elements press the edges 87 and 88 the one against the other with an enough force to ensure a certain sealing and the irreversible adhesion of the section 97 to the strip 96. Suitably, the sections 106 are covered of a rubber thickness 109 which uniformly distributes the pressure along the same edges, while the airholes allow the output of the air. Moreover, the section of the thickness 109 is shaped so as to make the sealing to begin from the bottom to the top of the strip 96, to avoid the formation of air bubbles in the area of sealing.

In detail, the sacks 24*a* and 24*b* are mounted in specular way in the vanes 78*a* and 78*b* and in which, for instance, the edge support elements 102*a* and 102*b* for the hooking sections 89 are adjacent to the walls of the safe: the edge support elements 102*a* and 102*b* are movable toward the elements 103*a* and 103*b* while the edge support elements 103*a* and 103*b* for the hooking sections 91 are arranged in a central area and are fixed. The moving of the elements 102*a* and 102*b* is actuated, along guides 110*a*, 110*b*, by respective motors 111*a*, 111*b* through a pulley and toothed belt transmission 112*a*, 112*b*.

It should be clear that, in alternative, the edge support elements adjacent to the walls can be fixed, and the edge support elements of the central area can be movable. The film control elements 104*a* and 104*b* are arranged above the edge support elements 102*a* and 102*b*, fulcrumed on fixed supports and which can be hooked to the elements 102*a* and 102*b* with possibility of unhooking. During the movement of the elements 102*a* and 102*b* and the removal of the elements 104*a* and 104*b* from the elements 102*a* and 102*b*, the movement of the edges 87 causes the progressive tear of the film 98, up to the complete extraction thereof when the edge 87 is close to the edge 88.

After the sealing of the sacks 24*a*, 24*b*, the movable edge support elements are moved away of few (around 10 mm) from the fixed support elements, without stressing the sealed sections. With the opening of the door 60, the transport operator can remove the hooking sections 89 and 91 from the pins 107, extract the sacks through the gap between the support elements and, further, remove the films 98 from the control elements 104*a* and 104*b*. With the safe 27 open and empty, the movable edge support elements are positioned at the opening condition, in response of a manual control of the motors 111*a*, 111*b* or through a mechanic unhooking. The operator can now hook the elements 104*a* and 104*b* to the elements 102*a* and 102*b* and mount empty sacks with the respective protective films 98, as previously described.

Suitably, not shown sensors are associated to the support elements 102*a*, 103*a*; 102*b*, 103*b*. The sensors verify the correct mounting of the sack hooking sections 89 and 91 to the edge support elements and the film hooking sections 99 to the film control elements 104*a* and 104*b*. The equipment 21 also comprises, for each vane 78*a*, 78*b*, a respective sack sensor couple 113*a*, 113*b* and a respective filling sensor couple 114*a*, 114*b*, formed each one of a photo-emitter and a photoelectric detector. It is also provided a, normally external, bar code reader, for reading the code of the value sack 24*a* or the sacks 24*a* and 24*b* preliminarily to the mounting on the safe.

The sack sensor couple 113*a*, 113*b* is arranged at the lower portion of the vane 78*a*, 78*b* and sends a signal of presence sack when the sack 24*a*, 24*b* is correctly installed and the opaque section 93 intercepts the rays directed to the photoelectric detector. The filling sensor couple 114*a*, 114*b* is arranged at the upper portion of the vane 78*a*, 78*b* and sends a signal of filled sack when the content of values of the sack 24*a*, 24*b* exceeds about ⅔ of the capacity of the sack in correspondence of the control area 95 and intercepts the rays directed to the photoelectric sensor.

Figure 8:
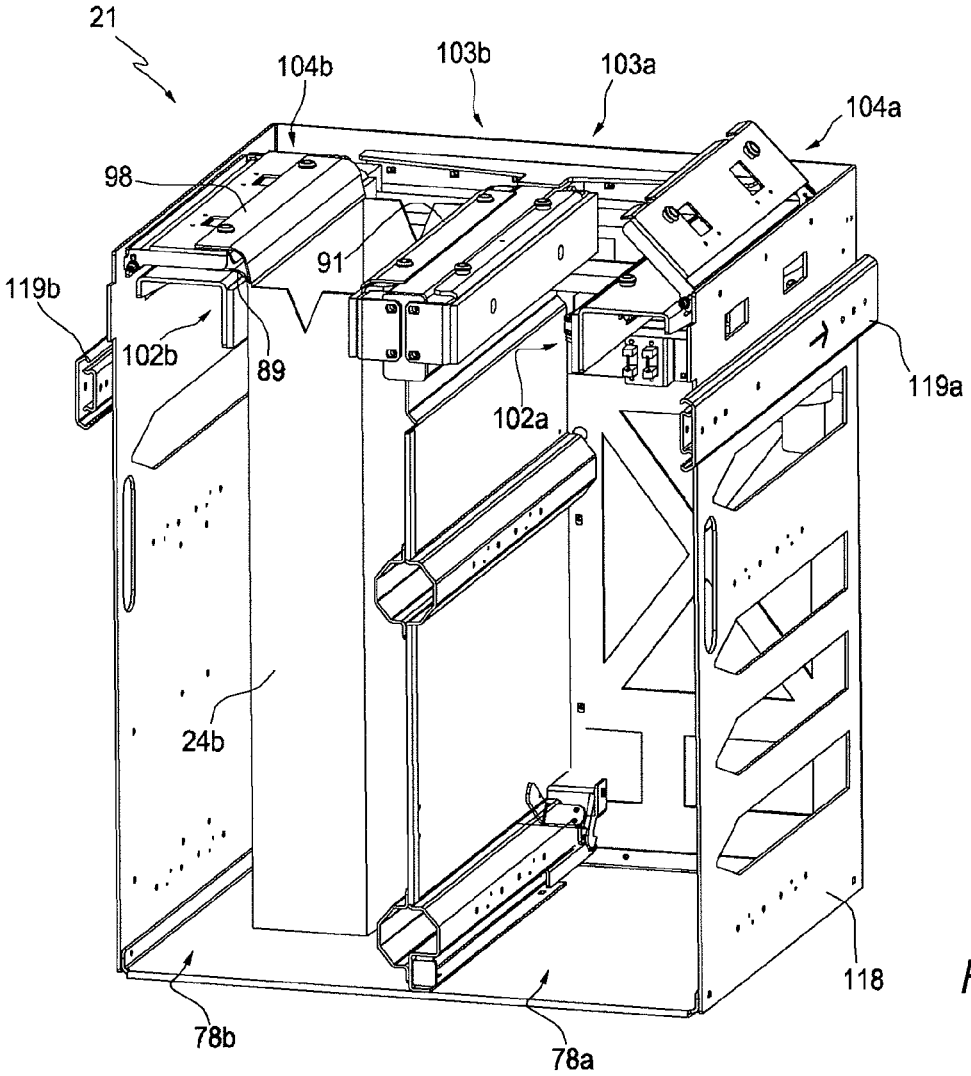
FIG. 8 is a view of other components of the equipment of FIG. 1.
Figure 8A:
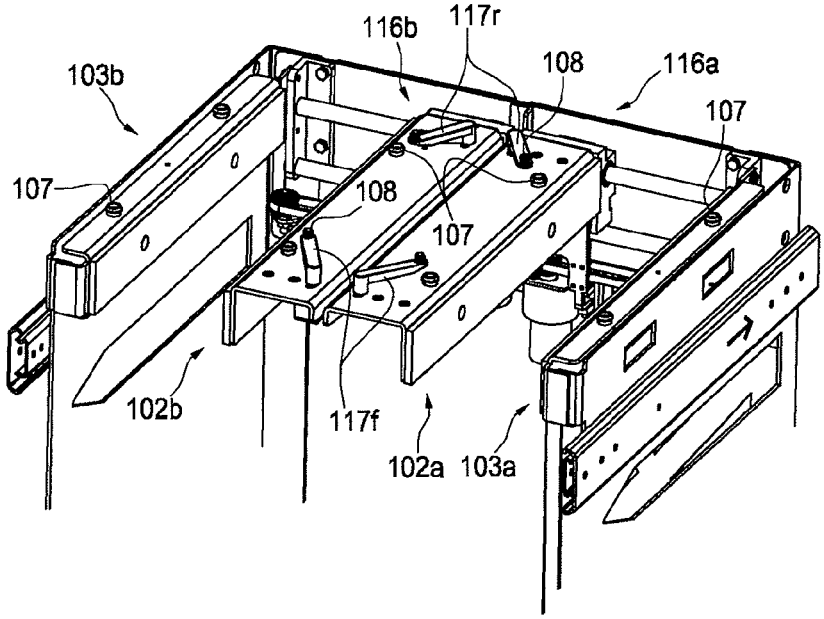
FIG. 8*a* represents a variant of some components of FIG. 8.

According to a variant represented in FIG. 8*a*, the edge support elements 102*a* and 102*b* have positions inverted with respect to the ones of FIG. 8. Film control elements, represented with 116*a* and 116*b*, can be actuated by autonomous mechanisms for rendering the extraction of the film 98 independent of the mutual movement of the edge support elements 102*a* and 102*b*. Each film control element comprises, for instance, two arms 117*f* and 117*r* supported by the upper sections of the support elements 102*a* and 102*b* and with possibility of rotation in horizontal. The arms 117*f* and 117*r* have, at the ends, the pins 108 and are actuated by respective motors, not shown, between a position of rest in which the pins 108 are adjacent to the respective pins 107 of the element 102*a*, 102*b* and a position of tear in which the pins 108 are moved away from the respective elements 107.

With the variant of FIG. 8*a*, as in the version of FIG. 8, the protective film 98 is drawn out preliminarily to the moving of the edge support elements 102*a*, 103*a*; 102*b*, 103*b*. However, after the sealing of the sack, the arms 117*f* and 117*r* are moved back to the position of rest, allowing the hooking of a new sack in the condition of removal of the edge support elements, without the need of a maximum separation. The separation will be automatically actuated after the closing of the door 60 and the control of the lock 60*a*.

The equipment 21 provides a program of assistance, with instructions visible on the display 33 for furnishing indications on the mounting of the value sack or sacks. On the basis of these indications, a value sack 24 is submitted to, the reading of the bar code, with respective memorization, for associating the values transferred to the sack to the read code and defining as first sack, the sack belonging to the first reading. The correct mounting of the sack in the vane 78*a* or in the vane 78*b* is verified by the signal of the sack sensing couple 113*a*, or 113*b*, while the respective lodging vane 78*a* or 78*b* is univocally associated to the code of the first sack. The second sack, after the reading of the bar code can be mounted in the other vane 78*b* or 78*a*, with univocal association of the code of the second sack to the respective transferred value and the respective lodging vane 78*b* or 78*a*.

Now, the CIT operator can close the transfer safe 27 with starting of a program of isolation of the sacks 24*a*, 24*b* and account of the introduced values. The access to the inside of the safe will be limited to the reception of the values up to the starting of the process of physical transfer of the values. The equipment 21 further verifies the regular receiving of the introduced values, as signalled by the transit sensor adjacent to the opening 61, by means of the filling sensor couple 114*a*, 114*b*. The reception of the values can be interrupted or on request of the cash personnel or in view of anomalies, or for a full load condition detected by the sensor couple 114*a*, 114*b* or in response to intervention of the CIT operator.

Suitably, the filling and sealing units 26*a* and 26*b* are mounted on a frame 118, open on the front, which takes up almost in full the useful space of the transfer safe 27. The frame 118 is supported by the side walls of the safe 27 through telescopic guides 119*a* and 119*b* which allow the partial extraction of the frame so as to facilitate the mounting and the removal of the value sacks 24*a* and 24*b*.

Figure 11:
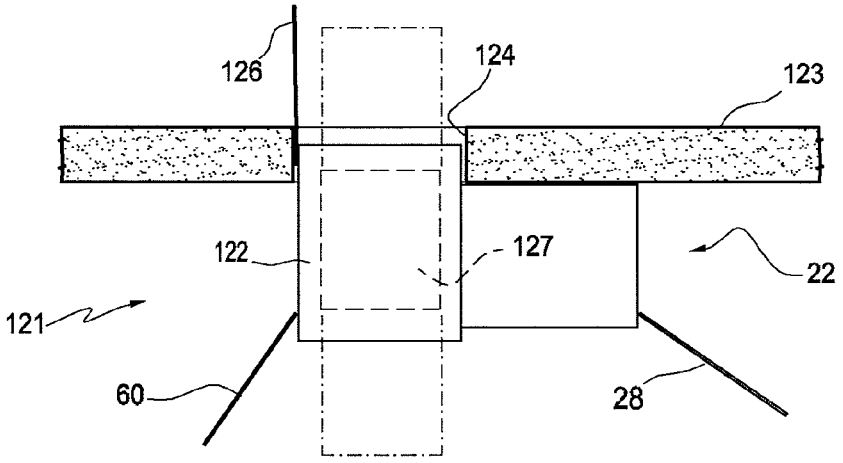
FIG. 11 shows a schematic top view of a variant of the equipment according to the invention, in a particular installation.

In FIG. 11, an equipment 121 according to the invention, with a transfer safe 122, is associated to the machine 22 for the automatic processing of values. The equipment 121 is provided for satisfying the need of the CIT transport operators of handling the value sacks 24*a* and 24*b* without access to the area designated for the deposit and the withdrawal of values through the machine 22. The equipment 121 is installed adjacent to a wall of separation 123, for instance between an inner area of access to the cash personnel and an external area accessible to the CIT personnel. The machine 22 is installed in the inner area together with a front portion of the transfer safe 122. Further, the safe 123 has a back portion, which extends rearward and is partially lodged in a passing opening 124 of the wall 123. Conveniently, the safe 122 provides a back door 126, adjunctive or substitutive of the door 60, which is accessible from the external area through the opening 124. A frame 127 for the unities 26*a* and 26*b* is also open rearward and can be drawn out through the opening 124 for the removal and the mounting of the value sacks 24*a* and 24*b*. The operations of access to the inside of the safe 122 by the CIT personnel through the rear door 126 and the handling of the sacks are similar to the ones executed through the door 60 and are not herein described.

According to the invention, the equipment 21, 121 allows to accomplish a method for making easier the account and transport of values deposited or to be deposited. This method provides the management of the deposit and withdrawal machine 22 entrusted to the deposit's organization owner of the values to be transferred, as usual. The deposit's organization also possesses the key of the deposit safe 28 and the cash personnel have, in particular, the authorization for the deposit in local of the values into the boxes 26, the delivery of values from the boxes 26 to the output port 37 and the transfer of the values from the boxes 26 or the transaction port 36 toward the equipment 21, 121. The deposit's organization has also access to the interface unit 32 and the introduction unit 42, but has not any access to the transfer safe 27.

The responsibility of the values in the safe transfer 27 is, on the contrary, of the CIT organization responsible for the transport, control and accounting of the values, which has already the accounting data of the transferred value and possesses the key of the transfer safe for the access therein, the removal of the sealed value sacks, and the mounting of empty and open sacks to be filled The operators of the CIT organization will not need of any presence of cash personnel for the removal of the sacks and the loading of the equipment 21 with the value sacks, but cannot tamper the value sacks without the tampering is evident.

With the structure of the invention, a method can be adopted for making easier the account and the transport of values in sack with advantage for the accreditation of the values in the deposit's account at the moment in which the values have been correctly stacked and bundled, physically entered into the safe transfer. It is made possible for the facts that:

a) the entering of the stacks 49 inside the transfer safe 27 is verified, while the filling and sealing unit or each filling and sealing unit is actuatable for the irreversible sealing of the sack or the sacks preliminary to the opening of the safe;

b) the accounting data associated to the values transferred to the stacks and functional to the transfer of the property of the values are sent to the CIT organization;

c) the personnel of the CIT organization has the key for the opening of the transfer safe 27 and the access to the value sacks 24*a*, 24*b* for the removal of the sack or the sacks irreversibly closed and the mounting of a new value sacks or new value sacks, with following closing of the transfer safe 27; and d) each information regarding the removal of the closed value sacks and the insertion of new value sacks, as detected by the sensors 113*a*, 113*b* and 114*a* and 114*b* is transmitted to the CIT organization.

In detail, each value sacks identified by the identification code read at the insertion of the sack in the transfer safe is followed during the various steps associated to the filling, sealing and removal. Further, the amount and other details of the values transferred in the value sack can be optionally printed on a receipt note emitted by the printer 34 and accompanying the removed sack.

Naturally, the principle of the invention remaining the same, the embodiments and the details of construction of the equipment for the storing of values in sack, can broadly be varied with respect to what has been described and illustrated, by way of non-limitative example, without departing from the ambit of the invention.

As an example, a printer device for the wrapper of the stack 51, not shown, can be associated to the bundling device 44. This device can print on the wrapper data regarding the typology of the bundled values and the contained values and other data.

The identification of the person which is proceeding to the opening of the transfer safe, the transfer of the full sacks and the mounting of the empty sacks can be controlled by means of fingerprint readers of known type.

As other anti-tampering measure, the sacks 24 can carry, as identifier, the identification code of the sack or other code or number associated thereto, carried on one of the edges 87 or 88, above of the area of sealing, for instance printed for being visually readable.

The equipment 21, 121 can provide a television camera arranged above the edge support elements and serviced by flash to take back the area of sealing together with the identification code through the gap between the support elements after their removal. The television camera is activated preliminarily to the opening of the transfer safe and the respective image is stored and associated with the other data for a faithful recording of the state of the sealing during the removal of the sack or the sacks.

The invention claimed is:

1. An equipment for the storing of values including banknotes, checks and other documents in sack, said equipment comprising a filling and sealing unit for a tamper evident value sack, wherein said equipment is coupled to a deposit and withdrawal machine for the automatic processing of values, wherein said deposit and withdrawal machine includes a deposit safe with a deposit safe key and lodging a series of value boxes and an interface unit for the deposit and withdrawal of values and wherein said interface unit comprises a transaction port for values to be deposited, an output port for the values to be withdrawn and a validation unit for the values to be deposited, a transport mechanism for moving the values between the transaction port and the boxes through the validation unit and between the boxes and the transaction port and an output for values to be transferred to the sack, said equipment further comprising a transfer safe and an introduction unit, wherein said transfer safe lodges the filling and sealing unit and the value sack, and said introduction unit is connected with the output of the interface unit for transferring values to be stored in the value sack and wherein said transfer safe includes an electronic lockable door for accessing to the filling and sealing unit and the value sack; said introduction unit including:

a stacking device for forming respective value stacks with the values to be stored in the value sack;

a bundling device for bundling as bundled stacks the value stacks formed by the stacking device; and a moving and transferring mechanism for shifting the value stacks between the stacking device and the bundling device and the bundled stacks between the bundling device and the filling and sealing unit; wherein the value sack has a mouth with two edges for a tamper evident sealing, while the filling and sealing unit is provided for mounting said sack and defining a condition of opening in which the edges are spaced away and the mouth is open for receiving said values, a condition of closing for the sealing of said edges and a condition of removal for the removal of a tamper evident sealed value sack, and wherein the electronic lockable door of said transfer safe can be closed and said equipment for the storing of values is operative after a correct mounting of an empty value sack while the opening of said door is provided for causing a tamper evident sealing of the value sack preliminary to the removal of a filled value sack wherein the transfer safe has an opening of passage for the bundled stacks and the filling and sealing unit defines a transfer passage for said bundled stacks, wherein the moving and transferring mechanism comprises stack shifting elements, opening/closing elements, a buffer seat interposed between said opening of passage and said transfer passage and a safety mechanism, and wherein the stack shifting elements are actuatable for shifting the value stacks from the stacking device to the bundling device and the bundled stacks from the bundling device to the transfer passage, while the opening/closing elements are actuatable between a condition of closing and a condition of opening of the transfer passage the buffer seat is positionable between a first position in communication with the transfer passage and a second position in communication with the opening of passage, and said safety mechanism is provided for positioning the buffer seat into said first position for receiving the bundled stack in the condition of opening of the opening/closing elements, positioning the buffer seat into the second position for transferring received stacks, and preventing a not authorized access to the filling and sealing unit in condition of missing or partial closing of the transfer passage by avoiding the buffer seat to be positioned into said second position.

2. An equipment for the storing of values including banknotes, checks and other documents in sack, said equipment comprising a filling and sealing unit for a tamper evident value sack, wherein said equipment is coupled to a deposit and withdrawal machine for the automatic processing of values, wherein said deposit and withdrawal machine includes a deposit safe with a deposit safe key and lodging a series of value boxes and an interface unit for the deposit and withdrawal of values and wherein said interface unit comprises a transaction port for values to be deposited, an output port for the values to be withdrawn and a validation unit for the values to be deposited, a transport mechanism for moving the values between the transaction port and the boxes through the validation unit and between the boxes and the transaction port and an output for values to be transferred to the sack, said equipment further comprising a transfer safe and an introduction unit, wherein said transfer safe lodges the filling and sealing unit and the value sack, and said introduction unit is connected with the output of the interface unit for transferring values to be stored in the value sack and wherein said transfer safe includes an electronic lockable door for accessing to the filling and sealing unit and the value sack; said introduction unit including:

a stacking device for forming respective value stacks with the values to be stored in the value sack;

a bundling device for bundling as bundled stacks the value stacks formed by the stacking device; and a moving and transferring mechanism for shifting the value stacks between the stacking device and the bundling device and the bundled stacks between the bundling device and the filling and sealing unit; wherein the value sack has a mouth with two edges for a tamper evident sealing, while the filling and sealing unit is provided for mounting said sack and defining a condition of opening in which the edges are spaced away and the mouth is open for receiving said values, a condition of closing for the sealing of said edges and a condition of removal for the removal of a tamper evident sealed value sack, and the electronic lockable door of said transfer safe can be closed and said equipment for the storing of values is operative after a correct mounting of an empty value sack while the opening of said door is provided for causing a tamper evident sealing of the value sack preliminary to the removal of a filled value sack; and wherein said equipment further comprises two filling and sealing units for two respective value sacks and a mechanism of exchange programmable for selectively shifting the bundled stacks between the bundling device and one or another of the filling and sealing units, the transfer safe has an upper safe surface defining an opening for the passage of the bundled stacks, and wherein the filling and sealing unit includes a separating plate arranged underneath the upper safe surface and the mechanism of exchange includes a shutter box devoid of bottom and top and interposed between the upper safe surface and the separating plate, said separating plate having two windows arranged above the value sacks, spaced each the other and vertically offset with respect to said opening for the passage of the bundled stacks, while the shutter box is shiftable between a position of receipt intermediate between the two windows and two positions of transfer: the position of receipt is such that the shutter box is vertically lined up with said opening for receiving the bundled stack with support on the separating plate, while said positions of transfer are such to register the shutter box with the one or the other of the two windows for the transfer of the bundled stacks into the one or the other of the two value sacks.

3. An equipment for the storing of values including banknotes, checks and other documents in sack, said equipment comprising a filling and sealing unit for a tamper evident value sack, wherein said equipment is coupled to a deposit and withdrawal machine for the automatic processing of values, wherein said deposit and withdrawal machine includes a deposit safe with a deposit safe key and lodging a series of value boxes and an interface unit for the deposit and withdrawal of values and wherein said interface unit comprises a transaction port for values to be deposited, an output port for the values to be withdrawn and a validation unit for the values to be deposited, a transport mechanism for moving the values between the transaction port and the boxes through the validation unit and between the boxes and the transaction port and an output for values to be transferred to the sack, said equipment further comprising a transfer safe and an introduction unit, wherein said transfer safe lodges the filling and sealing unit and the value sack, and said introduction unit is connected with the output of the interface unit for transferring values to be stored in the value sack and wherein said transfer safe includes an electronic lockable door for accessing to the filling and sealing unit and the value sack; said introduction unit including;

a stacking device for forming respective value stacks with the values to be stored in the value sack;

a bundling device for bundling as bundled stacks the value stacks formed by the stacking device; and a moving and transferring mechanism for shifting the value stacks between the stacking device and the bundling device and the bundled stacks between the bundling device and the filling and sealing unit; wherein the value sack has a mouth with two edges for a tamper evident sealing, while the filling and sealing unit is provided for mounting said sack and defining a condition of opening in which the edges are spaced away and the mouth is open for receiving said values, a condition of closing for the sealing of said edges and a condition of removal for the removal of a tamper evident sealed value sack, and wherein the electronic lockable door of said transfer safe can be closed and said equipment for the storing of values is operative after a correct mounting of an empty value sack while the opening of said door is provided for causing a tamper evident sealing of the value sack preliminary to the removal of a filled value sack; wherein the deposit and withdrawal machine is accessible across an internal area delimited by a wall of separation from an external area, said equipment is installed adjacent to said wall of separation at a side of the deposit and withdrawal machine, wherein said wall defines a passing opening, while the transfer safe has a portion housed in said passing opening and is provided of a lockable back door, adjunctive or substitutive of the lockable door, and wherein said lockable back door is operable from said external area for accessing to the filling and sealing unit and the value sack.

* * * * *